US007845283B2

(12) United States Patent
Finneral et al.

(10) Patent No.: US 7,845,283 B2
(45) Date of Patent: Dec. 7, 2010

(54) CONTROLLED DISPENSE SYSTEM FOR DEPLOYMENT OF COMPONENTS INTO DESIRED PATTERN AND ORIENTATION

(75) Inventors: Henry Finneral, Tewksbury, MA (US); Joseph Kealos, Wilmington, MA (US); John J. Prendergast, Haverhill, MA (US)

(73) Assignee: Textron Systems Corporation, Wilmington, MA (US)

( * ) Notice: Subject to any disclaimer, the term of this patent is extended or adjusted under 35 U.S.C. 154(b) by 0 days.

(21) Appl. No.: 11/804,004

(22) Filed: May 16, 2007

(65) Prior Publication Data

US 2007/0266884 A1 Nov. 22, 2007

Related U.S. Application Data

(60) Provisional application No. 60/800,828, filed on May 16, 2006.

(51) Int. Cl.
*F42B 12/58* (2006.01)

(52) U.S. Cl. ..... 102/489; 102/393; 102/386; 102/357; 89/1.11

(58) Field of Classification Search ..... 102/357, 102/340, 489, 393, 386; 89/1.11
See application file for complete search history.

(56) References Cited

U.S. PATENT DOCUMENTS

| | | | | |
|---|---|---|---|---|
| 32,689 | A * | 7/1861 | Gault | 102/400 |
| 2,317,256 | A * | 4/1943 | De Kurowski | 102/387 |
| 3,246,864 | A * | 4/1966 | Mack et al. | 244/138 A |
| 3,276,367 | A | 10/1966 | Edwards | |
| 4,614,318 | A * | 9/1986 | Gobel | 244/3.21 |

(Continued)

FOREIGN PATENT DOCUMENTS

| | | |
|---|---|---|
| DE | 3705383 A1 | 9/1988 |

(Continued)

OTHER PUBLICATIONS

Textron Systems, Universal Aerial Delivery Disperser (U-ADD) Product Information, 2006.

*Primary Examiner*—James S Bergin
*Assistant Examiner*—Daniel J Troy
(74) *Attorney, Agent, or Firm*—BainwoodHuang

(57) ABSTRACT

A dispenser system provides a means to automatically deploy systems using a controlled dispense approach capable of providing desired operational flexibility. Components such as unattended ground sensors (UGS) are deployed according to a method which includes incorporating the components into an elongated ejection system to form a payload assembly, the ejection system including axially-displaced ejector bays each for holding respective components. Each ejector bay retains the respective components until a respective ejection event upon which the ejector bay ejects the components in a radial direction. The payload assembly includes a stabilizer such as a drogue parachute that substantially prevents the payload assembly from rotating about its elongated axis. A timing sequence for the ejection events is programmed into the ejection system to achieve a desired coverage pattern of the components after deployment. The timing sequence can be chosen to result in a coverage pattern along a continuum from maximum component density to maximum total area coverage. The payload assembly is subsequently released from an aerial vehicle above the area with activation of the timing sequence, such that the ejection events occur during flight of the payload assembly at respective times after its release.

16 Claims, 4 Drawing Sheets

U.S. PATENT DOCUMENTS 4,651,648 A * 3/1987 Alon ..... 102/387
4,676,167 A * 6/1987 Huber et al. ..... 102/393
4,714,020 A * 12/1987 Hertsgaard et al. ..... 102/351
4,750,423 A * 6/1988 Nagabhushan ..... 89/1.51
4,867,034 A 9/1989 Trosky et al.
4,869,174 A 9/1989 Hanser et al.
5,094,170 A * 3/1992 Raynaud et al. ..... 102/489
5,189,248 A * 2/1993 Deffayet et al. ..... 102/386
5,225,627 A 7/1993 Phillips
6,531,965 B1 * 3/2003 Kaiser et al. ..... 340/870.01

FOREIGN PATENT DOCUMENTS

DE 3809177 C1 6/1989

* cited by examiner

5(a) 5(b)

CONTROLLED DISPENSE SYSTEM FOR DEPLOYMENT OF COMPONENTS INTO DESIRED PATTERN AND ORIENTATION

CROSS REFERENCE TO RELATED APPLICATIONS

This Patent Application is a non-provisional of U.S. Provisional Patent Application No. 60/800,828 filed on May 16, 2006 entitled, "Controlled Dispense System For Deployment Of Lethal And Non-Lethal Payloads", the contents and teachings of which are hereby incorporated by reference in their entirety.

BACKGROUND

The nature of modern warfare continues to evolve as the soldier's requirements for enhanced knowledge of enemy movement and assured battlefield control are key elements of the Brigade Combat Team's (BCT) tactics, techniques and procedures. Remote unattended sensor and munitions systems are significant contributors to the developing capability to meet these requirements. These remote systems form unmanned robotic squads that provide the maneuver commander with crucial battlefield information and provide for lethal and non-lethal effect response autonomously. To date these systems have required hand emplacement adding to the soldier's workload and exposing them to potential hostile environments.

SUMMARY

The dispenser system described herein provides a means to automatically deploy these advanced systems using a controlled dispense approach capable of providing the operational flexibility required.

In particular, a method is disclosed of deploying unattended ground components in an area. The method includes incorporating the components into an elongated ejection system to form a payload assembly, the ejection system including a plurality of axially-displaced ejector bays each for holding respective ones of the components. Each ejector bay is operative to retain the respective components until a respective ejection event upon which the ejector bay ejects the components of the ejector bay in a generally radial direction. The payload assembly includes a stabilizer operative upon deployment to substantially prevent the payload assembly from rotating about its elongated axis. In one embodiment, the stabilizer is realized by a small drogue parachute that is deployed upon release of the payload assembly.

A timing sequence is programmed into the ejection system according to which the respective ejection events for the ejection bays are to occur to achieve a desired coverage pattern of the components after deployment. The timing sequence can be chosen to result in a coverage pattern along a continuum from maximum component density to maximum total area coverage.

The payload assembly is subsequently released from an aerial vehicle above the area with activation of the timing sequence, such that the ejection events occur during flight of the payload assembly at respective times after its release.

BRIEF DESCRIPTION OF THE DRAWINGS

The foregoing and other objects, features and advantages will be apparent from the following description of particular embodiments of the invention, as illustrated in the accompanying drawings in which like reference characters refer to the same parts throughout the different views. The drawings are not necessarily to scale, emphasis instead being placed upon illustrating the principles of various embodiments of the invention.

DETAILED DESCRIPTION

The Controlled Dispense System (CDS) is a dispensing concept for unattended components such as tactical unattended ground sensors (UGS) and intelligent munitions (IMS) that utilizes a multi-staged release approach to achieve a desired ground pattern.

Figure 1:
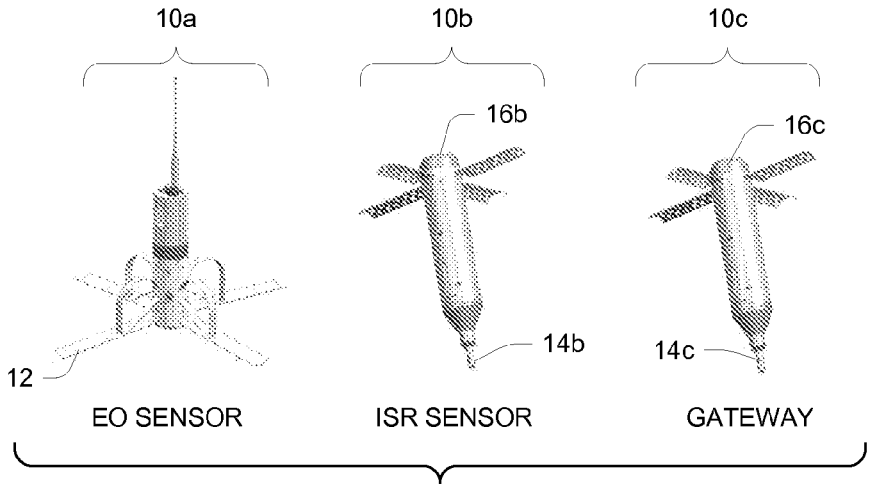
FIG. 1 is a diagram illustrating various deployable components.

FIG. 1 shows deployable components 10 that can make up a UGS system. They include electro-optical (EO) sensors 10*a*, intelligence, surveillance and reconnaissance (ISR) sensors 10*b*, and gateway sensors 10*c*. Examples of the dimensions of such components 10 are provided in FIG. 1. It is to be noted that the components 10 all have a desired upright orientation (shown) in which they should be emplaced in/on the ground for proper operation. The EO sensor 10*a* rests on a set of foot-like protrusions 12. Both the ISR sensor 10*b* and the gateway sensor 10*c* have tip-like extensions 14*b*, 14*c* that are meant to penetrate vertically into the ground, so that the overall sensor is coupled to the ground while maintaining the respective upper body portion 16*b*, 16*c* above the ground in an upright position.

Figure 2:
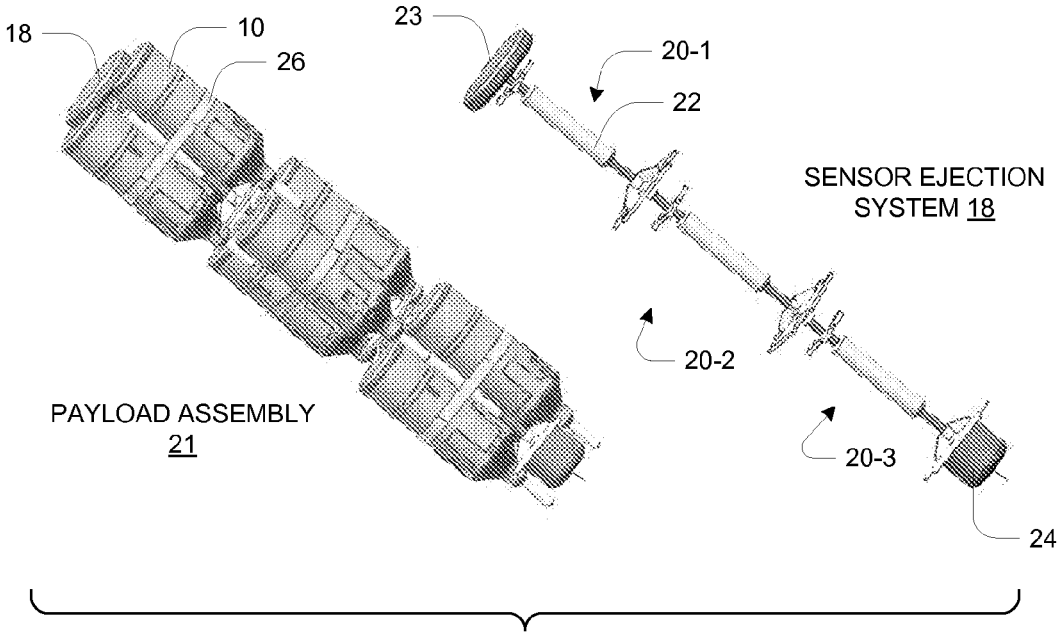
FIG. 2 is a diagram illustrating a sensor ejection system according to one embodiment.

FIG. 2 shows a sensor ejection system (SES) 18, both unloaded (on the right in FIG. 2) and as part of a payload assembly 21 loaded with components 10 to be dispensed (on the left). The components 10 have a form factor enabling them to be packaged onto the SES 18, specifically in three (3) bays 20-1, 20-2 and 20-3 each holding three (3) components 10, for a total of nine (9) field deployable components 10 per payload assembly 21 as shown. As described below, this arrangement enables the remote deployment of the components 10 with both down-range and cross-range separation as may be required by a variety of particular mission scenarios. The system is capable of controlling the release and enables a specific ground pattern to be generated. Each bay 20 is equipped with an ejection capability that deploys the three components 10 radially, generating the cross-range separation. Ejection events are sequenced in time by on-board control circuitry 23 to configure the dimension of the down-range ground pattern. The field can be configured to maximize the area coverage (long timeline) or maximize the emplacement density (short timeline). In one embodiment, the ejection capability may be realized with inflatable air bags 22 and a gas generator 24 that causes the air bags to inflate very quickly in response to a control pulse, breaking retention bands 26 used to hold the components 10 in place until ejected by the SES 18. Other types of ejection capabilities may be used in alternative embodiments, including for example a piston mechanism.

The complexity of the advanced systems and nature of multimode sensor systems requires a smart deployment scheme to maximize system performance. The controlled dispense solution described herein provides precise emplacement remotely from a single dispense event by automatically inducing specific release conditions to the components 10 at stages to generate an optimized ground pattern. The pattern provides for a flexible building block that can be mapped into a multitude of remotely deployed mission scenarios.

Figure 3:
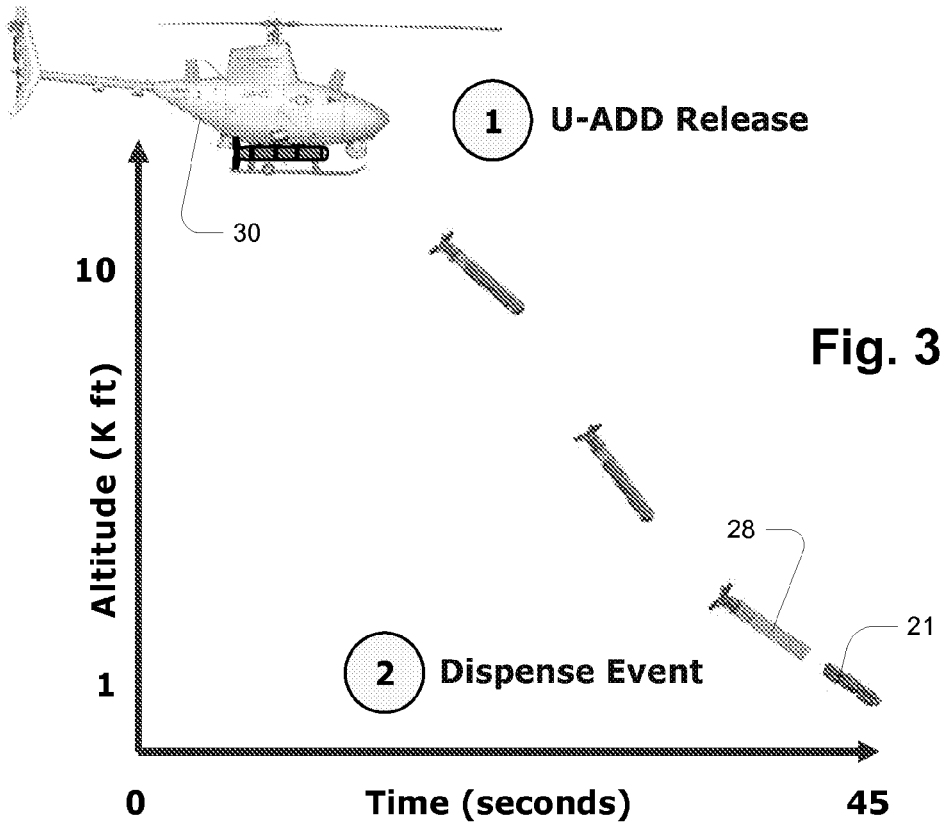
FIG. 3 depicts the release of a guided dispenser and a subsequent dispensing of a sensor ejection system.

FIG. 3 illustrates a deployment scenario according to one embodiment. The payload assembly 21 is incorporated into a GPS-guided dispenser 28 such as the Textron Universal Aerial Delivery Dispenser (U-ADD). The U-ADD is a guided delivery system designed to deliver payloads from a helicopter or an unmanned aerial vehicle (UAV). In operation, a soldier inputs mission planning information into a control station such as field location coordinates and dispense ejection timing sequence. This information is subsequently downloaded to the dispenser 28, including to control circuitry (e.g. processor electronics) in the SES 18 that utilizes the information to generate ejection control signals at the proper times. As shown in FIG. 3, the guided dispenser 28 (with payload assembly 21 therein) is released from the air vehicle 30 (a helicopter in the illustrated example) at an altitude of 10,000-15,000 feet. The guided dispenser 28 accelerates and uses GPS/IMU guidance and control to maneuver to a deployment point. At that point, the dispenser 28 opens and the payload assembly 21 is pushed out of the front of the dispenser 28.

Figure 4:
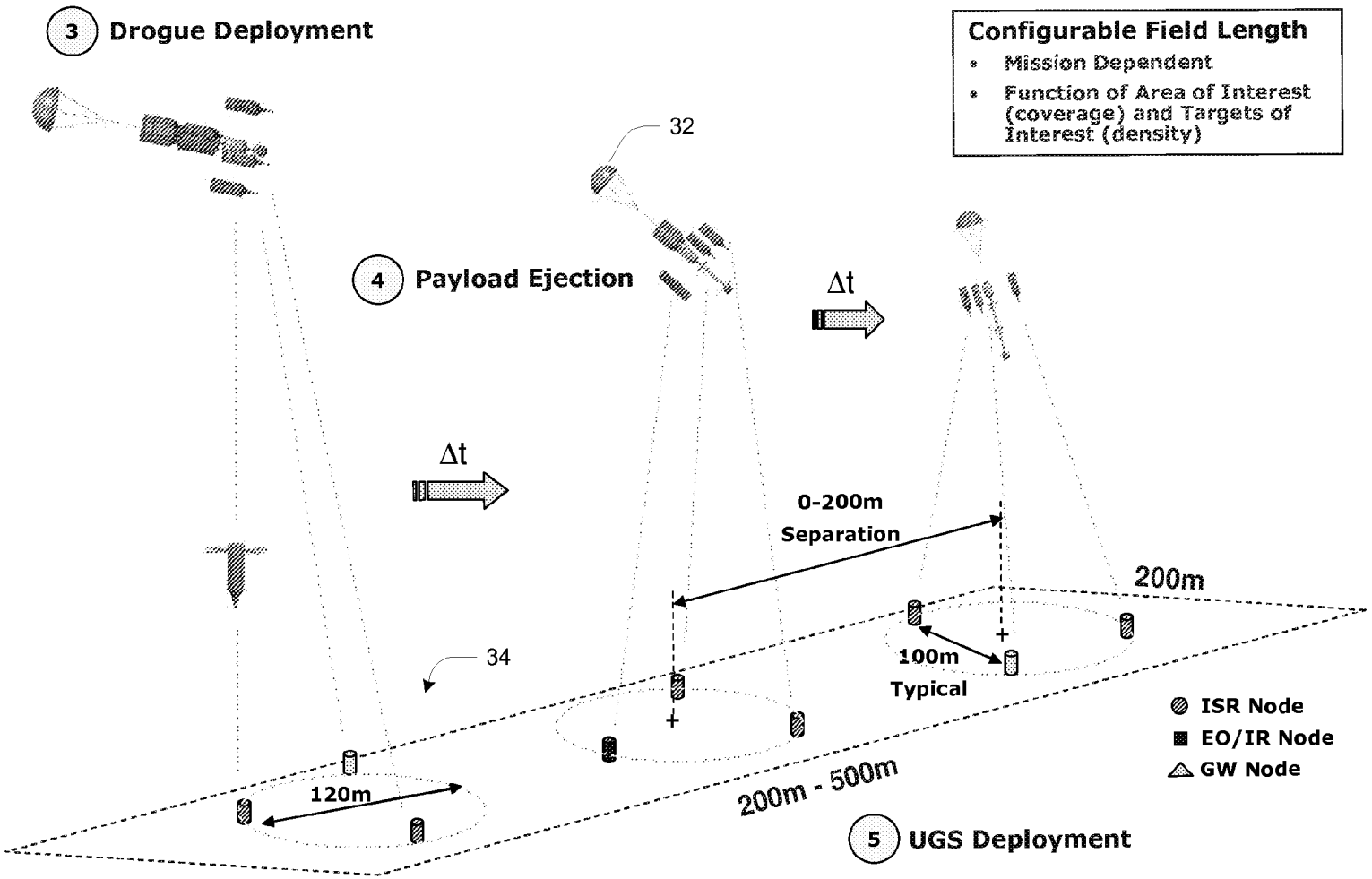
FIG. 4 illustrates a sequence of ejection of deployable components and a pattern of coverage achieved thereby.

Referring now to FIG. 4, after being released from the dispenser 28, the payload assembly 21 deploys a small drogue parachute 32 to orient and stabilize the payload assembly 21 and then initiates a timing sequence for ejection of the components 10. First, the three components 10 in the forward bay 20-3 are ejected radially to generate a first circular pattern 34. In one embodiment, the circular pattern 34 has a radius of approximately 120 meters, resulting in a typical 100-meter chord spacing of components 10 on the ground. The components 10 of the middle and aft bays 20-2 and 20-1 are ejected in sequence thereafter. The timing of the ejection of the middle and aft bays 20-2 and 20-1 results in the desired ground pattern. The distance between the centers of the circular patterns 34 is 0-200 meters in one embodiment.

As noted above, the components 10 may consist of one or more types of sensors. Each sensor component 10 is configured to impact the ground so as to have a desired orientation during subsequent operation. Once these impact the ground, they automatically begin an operation of initialization, field mapping and reporting back to a tactical network. Generally, the sensor components 10 have a bottom-heavy weight distribution and drag-brake stabilizer feature so that they attain the desired orientation during the fall to the ground. The tip-like extensions 14 of sensors such as the ISR sensor 10*b* and gateway sensor 10*c* are driven into the ground so that the sensor body 16 has an upright position upon emplacement. To achieve this type of emplacement, it is desired that the components 10 have primarily a downward component of motion, with little or no lateral or angular motion component. This type of motion is provided by the illustrated dispensing technique in which the payload assembly 21 is delivered to an ejection point by a guided, non-spinning dispenser 28 such as the U-ADD, and then released with deployment of the drogue parachute 32 to enhance stability during the ejection sequence.

Figure 5:
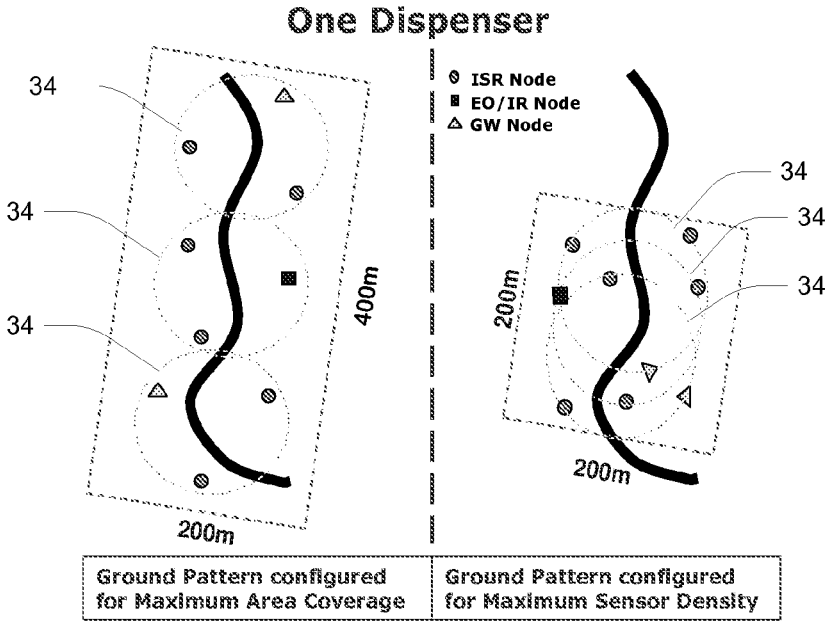
FIG. 5 illustrates alternative ground patterns that can be achieved.

The system can be programmed to provide field configurations that scale from 200×200 meters to 200×500 meters in one embodiment, depending on the area of interest and targets of interest of the mission. FIG. 5 illustrates the extremes in this case. FIG. 5(*a*) shows a pattern of maximum area coverage in which the three circular patterns 34 are offset from each other by substantially the diameter of each pattern 34. FIG. 5(*b*) shows a pattern of maximum density in which the three circular patterns 34 are offset by a much smaller amount, for example on the order of 20-50 meters. It will be appreciated that the variation is achieved by alternating the amount of time between the ejections of the respective bays 20 relative to the down-range speed of the payload assembly 21 after release. If down-range velocity is 25 meters/second, for example, then the pattern in FIG. 5(*a*) can be achieved using an ejection separation of 8 seconds, and the pattern of FIG. 5(*b*) can be achieved using an ejection separation of 1-2 seconds. This flexibility enables the sensor delivery to be tailored to different mission scenarios in alignment with different tactical field requirements. In one embodiment, intelligent munitions can be overlaid with unattended ground sensors in a 200×200 meter tactical field where the sensors and munitions would self-form a network and report into a higher level field network.

Figure 6:
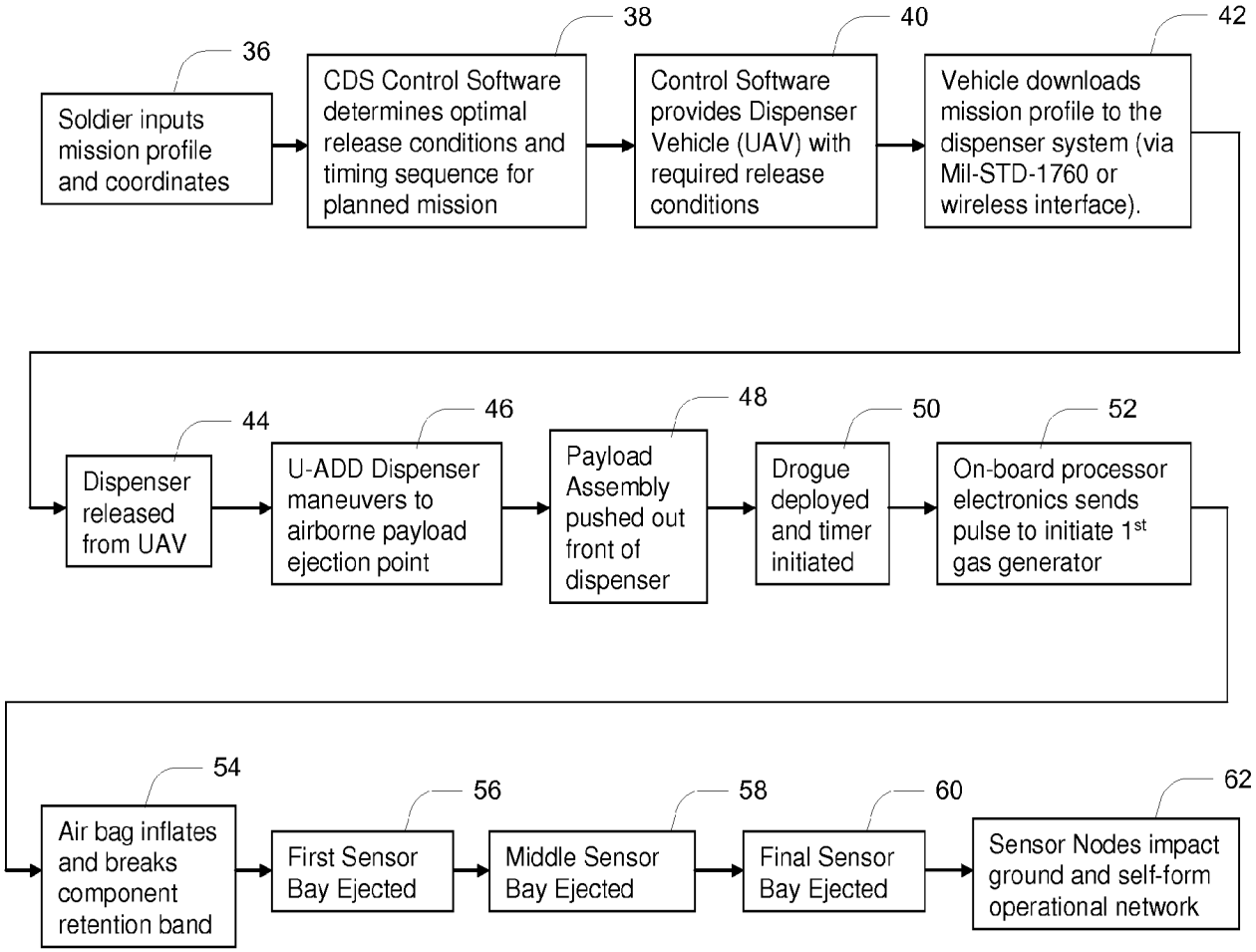
FIG. 6 is a flow diagram of overall operation according to an embodiment.

FIG. 6 is a flow chart for the above-described operation. The steps 36-42 are preparatory steps involving the determination of the timing sequence and downloading of the mission information (including timing sequence) to the dispenser 28 and sensor payload 21. Steps 44-48 are the release and maneuvering of the guided dispenser 28 to the ejection point and the release of the payload assembly 21, and step 50 is the deployment of the drogue parachute 32. Steps 52-56 are performed to eject the components 10 in the forward bay 20-3, and steps 58-60 represent the repetition of steps 52-56 for each of the mid and aft bays 20-2 and 20-1. At step 62, the components 10 (such as sensors) impact the ground and begin operation.

While various embodiments of the invention have been particularly shown and described, it will be understood by those skilled in the art that various changes in form and details may be made therein without departing from the spirit and scope of the invention as defined by the appended claims.

What is claimed is:

1. An elongated ejection system for use in deploying a plurality of unattended ground components in an area, the ejection system comprising:

a plurality of axially-displaced ejector bays for respective sets of the components, each ejector bay being configured to retain the respective components until a respective ejection event, and being further configured and operative upon occurrence of the ejection event to eject the respective components in a generally radial direction;

a stabilizer operative upon deployment to substantially prevent the elongated ejection system from rotating about its elongated axis and promote required ground penetration and ground coupling of the components; and control circuitry operative to generate the respective ejection events for the ejector bays according to a predetermined sequence after release of the ejection system over the area to achieve a desired coverage pattern of the components;

wherein the stabilizer includes a drogue parachute deployed upon release of a payload assembly including the elongated ejection system;

wherein the components include tip portions for penetrating ground in the area and include bottom-heavy weight distribution and drag-brake stabilizers to attain a desired upright, tip-downward orientation before striking the ground after ejection from the ejector bays and the components are oriented in the ejector bays with the tip portions facing away from the drogue parachute;

wherein each component includes a ground sensor which is constructed and arranged to (i) install in the ground in a substantially upright position and, after installing in the ground in the substantially upright position, (ii) electronically communicate with a tactical network device;

wherein the control circuitry, when generating the respective ejection events, is constructed and arranged to receive downloaded information and to utilize the downloaded information to generate ejection control signals to effect the ejection events according to the predetermined sequence;

wherein, in response to the ejection control signals, the ejection events include (i) a first ground sensor ejection event which involves radially ejecting a first group of ground sensor from a first axially-displaced ejector bay of the plurality of axially-displaced ejector bays at a first time to form a first ground sensor coverage pattern on the ground, and (ii) a second ground sensor ejection event which involves radially ejecting a second group of ground sensor from a second axially-displaced ejector bay of the plurality of axially-displaced ejector bays at a second time to form a second ground sensor coverage pattern on the ground; and wherein the downloaded information effects a selection of an amount of time relative to a down-range speed of the elongated ejection system effective to achieve the desired coverage pattern, the selected amount of time falling in a range from a first short time during which the elongated ejection system travels down-range by less than a cross-range extent of the desired coverage pattern to a second long time during which the elongated ejection system travels down-range by a multiple of the cross-range extent of the desired coverage pattern.

2. An elongated ejection system according to claim 1, wherein each of the ejector bays includes an inflatable bag operative to be inflated so as to urge the components radially outward as part of the respective ejection event.

3. An elongated ejection system according to claim 2, wherein the components of each ejector bay are retained by a respective retention band prior to the respective ejection event, and wherein pressure generated by inflation of each inflatable bag is sufficient to break the respective retention band.

4. An elongated ejection system according to claim 1, wherein each of the ejector bays is configured to hold three of the components arranged symmetrically about the axis of the elongated ejection system.

5. An elongated ejection system according to claim 1, wherein the cross-range extent of the desired coverage pattern is substantially 120 meters, the down-range speed of the elongated ejection system is substantially 25 meters per second, the first short time is substantially 1-2 seconds, and the second long time is substantially 8 seconds.

6. An assembly for use in deploying a plurality of unattended ground components in an area, comprising:

the elongated ejection system of claim 1 incorporating the unattended ground components in the ejector bays to form a payload assembly; and a guided dispenser containing the payload assembly, the guided dispenser being configured and operative to (i) be released from an aerial vehicle at a dispenser release point, (ii) travel from the dispenser release point to a payload release point, and (iii) release the payload assembly at the payload release point.

7. An elongated ejection system according to claim 1, wherein each ground sensor, when installing in the ground in the substantially upright position, is constructed and arranged to:

impact the ground, perform an initialization operation in response to impacting the ground, and perform a field mapping operation after completion of the initialization operation.

8. An elongated ejection system according to claim 7, wherein each component, when electronically communicating with the tactical network device, is constructed and arranged to transmit field mapping data to the tactical network device in a remotely-powered, wireless manner.

9. An elongated ejection system according to claim 1, wherein the plurality of unattended ground components includes a first set of components, and a second set of components;

wherein the second axially-displaced ejector bay which is adjacent the first axially-displaced ejector bay; and wherein the elongated ejection system further comprises:

a first retention band which is constructed and arranged to (i) hold the first set of components within the first axially-displaced ejector bay prior to the first ejection event, and (ii) break to release the first set of components from the first axially-displaced ejector bay during the first ejection event, and a second retention band which is constructed and arranged to (i) hold the second set of components within the second axially-displaced ejector bay during the first ejection event and prior to the second ejection event, and (ii) break to release the second set of components from the second axially-displaced ejector bay during the second ejection event, the second ejection event occurring after the first ejection event.

10. An elongated ejection system according to claim 9, wherein each component of the second set of components includes a tip-like extension which axially extends from the second axially-displaced ejector bay into the first axially-displaced ejector bay while the first set of components reside in the first axially-displaced ejector bay, the tip-like extension of that component body being constructed and arranged to couple the ground sensor of that component to the ground (i) after installation of the ground sensor and (ii) when the ground sensor electronically communicates with the tactical network device.

11. An elongated ejection system according to claim 10, wherein each component of the second set of components further includes multiple drag-brake stabilizers which are in retracted positions prior to the second ejection event and extended positions after the second ejection event, the multiple drag-brake stabilizers residing at an end of that component which is opposite the tip-like extension of that component.

12. An elongated ejection system according to claim 9 wherein the drogue parachute, after deployment, is constructed and arranged to orient and stabilize the payload assembly during the first ejection event and during the second ejection event occurring after the first ejection event.

13. An elongated ejection system according to claim 1 wherein the first ground sensor coverage pattern on the ground is different than the second ground sensor coverage pattern on the ground.

14. An elongated ejection system according to claim 1 wherein the first ground sensor coverage pattern on the ground is non-overlapping with the second ground sensor coverage pattern on the ground.

15. An elongated ejection system according to claim 1 wherein the first ground sensor coverage pattern on the ground is overlapping with the second ground sensor coverage pattern on the ground.

16. An elongated ejection system according to claim 1 wherein the ejection events further include a third ground sensor ejection event which involves radially ejecting a third group of ground sensors from a third ejector bay of the plurality of axially-displaced ejector bays to form a third ground sensor coverage pattern on the ground, the third ground sensor coverage pattern being different than the first and second ground sensor coverage patterns.

* * * * *